US008857313B2

(12) United States Patent
Ridder et al.

(10) Patent No.: US 8,857,313 B2
(45) Date of Patent: Oct. 14, 2014

(54) FLUID OPERATED ACTUATOR SYSTEM

(75) Inventors: Herbert Ridder, Rheinberg (DE); Gerhard Bohmer, Wesel (DE); Martin Engels, Alpen (DE)

(73) Assignee: Norgren GmbH, Alpen (DE)

( * ) Notice: Subject to any disclaimer, the term of this patent is extended or adjusted under 35 U.S.C. 154(b) by 453 days.

(21) Appl. No.: 13/059,689

(22) PCT Filed: Sep. 9, 2008

(86) PCT No.: PCT/EP2008/007370
§ 371 (c)(1),
(2), (4) Date: Feb. 18, 2011

(87) PCT Pub. No.: WO2010/028662
PCT Pub. Date: Mar. 18, 2010

(65) Prior Publication Data

US 2011/0146804 A1 Jun. 23, 2011

(51) Int. Cl.
*F15B 13/043* (2006.01)
*F15B 13/042* (2006.01)

(52) U.S. Cl.
CPC ..... *F15B 13/042* (2013.01); *F15B 2211/329* (2013.01); *F15B 2211/851* (2013.01)
USPC ..... 91/433; 137/625.64

(58) Field of Classification Search
CPC .. F16K 11/07; F15B 13/0402; F15B 13/0431; F15B 13/0435
USPC ..... 137/625.64, 625.66; 91/433
See application file for complete search history.

(56) References Cited

U.S. PATENT DOCUMENTS

| | | | | |
|---|---|---|---|---|
| 4,052,929 | A * | 10/1977 | Baatrup et al. | 91/29 |
| 4,649,957 | A | 3/1987 | Quinn | |
| 4,926,906 | A | 5/1990 | Ichihashi | |
| 5,992,294 | A * | 11/1999 | Seddon | 91/433 |
| 6,341,552 | B1 * | 1/2002 | Potter et al. | 91/433 |
| 6,755,214 | B2 * | 6/2004 | Bento | 137/625.64 |
| 7,100,639 | B2 * | 9/2006 | Rub | 137/625.64 |
| 7,779,863 | B2 * | 8/2010 | Jacobsen et al. | 137/596.15 |

FOREIGN PATENT DOCUMENTS

| | | | | |
|---|---|---|---|---|
| DE | 4421357 | A1 * | 12/1995 | F15B 13/04 |
| DE | 10107868 | A1 | 9/2002 | |
| EP | 0198234 | A2 | 10/1986 | |

OTHER PUBLICATIONS

"Grundlagen und Gerate-Funktionsbeschreibung Nr. 1 829 929 007" Bosch-Pneumatik Informationen. Grundlagen Und Geraetefunktionsbeschreibung, XX, XX, Sep. 1, 1977, p. 33 XP002127383.

* cited by examiner

*Primary Examiner* — Stephen M Hepperle
*Assistant Examiner* — R. K. Arundale
(74) *Attorney, Agent, or Firm* — The Ollila Law Group LLC

(57) ABSTRACT

An actuation system (200) is provided. The actuation system (200) includes a fluid operated actuator (211) and a control valve (230). The control valve (230) is movable between a first position and a second position and is adapted to open a fluid flow path from a pressurized fluid supply (240) to the actuator (211) when the control valve (230) is in the first position. A diverting fluid conduit (246) is provided that is adapted to divert a portion of the pressurized fluid supplied to the actuator (211) when the control valve (230) is in the first position. The pressurized fluid diverted through fluid conduit (246) biases the control valve (230) towards a second position.

12 Claims, 4 Drawing Sheets

FLUID OPERATED ACTUATOR SYSTEM

TECHNICAL FIELD

The present invention relates to a fluid operated actuator, and more particularly, to a valve control system for a fluid operated actuator.

BACKGROUND OF THE INVENTION

Fluid controlled actuators are known in the art. According to one design, fluid provided to the actuator is controlled using a control valve actuated by two or more pilot valves. The pilot valves control a pressure supply to the control valve, which actuates the control valve to a first or a second position. Such a configuration has received some success, however, the system is complex, bulky, and requires excessive time to react and change the position of the actuator.

FIG. 1 shows a valve control system 100 according to the prior art. The valve control system 100 as shown in FIG. 1 includes an actuator 101, a pressurized fluid conduit 102, a first pilot valve 103, a second pilot valve 104, and a control valve 105. In response to pressurized fluid acting on the actuator 101, either through conduit 106 or through conduit 107, the piston 108 of the actuator 101 moves between a first and a second position. The pressurized fluid may comprise any manner of substantially incompressible fluid, such as pneumatic or hydraulic fluid, for example. Typically, the pressurized fluid used will depend on the particular application.

The pressurized fluid supplied to the actuator 101 is determined based on the position of the control valve 105. The control valve 105 is actuated using the first and second pilot valves 103, 104. In situations where the pilot valves 103, 104 comprise solenoid pilot valves, excitation of solenoid coils (not shown) will actuate the pilot valve, allowing the pressurized fluid to flow to the control valve 105. For example, if the first pilot valve 103 is actuated, the port 112 of the pilot valve 103 is opened to the port 113, thus allowing the pressurized fluid to act on the first side 127 of the control valve 105 through conduit 123. Pressure acting on the first side 127 of the control valve 105 moves the control valve 105 to a first position. In the first position, port 115 of the control valve 105 is opened to the port 116, thus providing an open path from the conduit 111 to the conduit 107. In this position, pressure acts in chamber 125 moving the piston 108 to the left as shown in FIG. 1, while allowing fluid from chamber 126 to exhaust through port 119 of the control valve 105 via conduit 106.

When it is desired to move the piston 108 in the other direction, the first pilot valve 103 is de-actuated and the second pilot valve 104 is actuated, thereby closing the port 112 from the port 113 and opening the port 120 to the port 121 of the second pilot valve 104. The pressurized fluid can then flow from the conduit 110 to the second side 128 of the control valve 105 to move the control valve 105 to a second position. In the second position, port 115 is opened to port 118 of the control valve 105. The pressurized fluid can then flow from the conduit 111 to the conduit 106 to pressurize the chamber 126 of the actuator 101, thereby moving the piston 108 to the right.

Although the design described above can function in limited situations, the valve control system 100 requires an excessive amount of space, power, and components by requiring the use of two pilot valves. Furthermore, there is a delayed response time in switching the actuator 101 because one pilot valve needs to be de-actuated and another pilot valve needs to be actuated prior to any movement of the control valve 105. In addition, each pilot valve has an inherent delay time, and therefore, providing multiple pilot valves compounds the problem. This delay can create problems in situations where the actuator is switched in a repetitive manner or in situations where a fast response time is required.

Therefore there is a need for a fast responding fluid controlled actuator that also minimizes the materials and space required. The present invention solves this and other problems and an advance in the art is achieved.

Aspects

According to an aspect of the invention, a method for operating a control valve adapted to selectively provide a pressurized fluid supply to an actuator, comprises the step of:

actuating the control valve to a first position to open a fluid flow path from a pressurized fluid supply to the actuator, wherein the pressurized fluid supplied to the actuator also biases the control valve towards a second position.

Preferably, the method further comprises the step actuating the control valve to the second position with the pressurized fluid supplied to the actuator.

Preferably, the pressurized fluid biasing the control valve towards the second position is exhausted once the control valve is in the second position.

Preferably, the step of actuating the control valve to the first position comprises applying a force to a first side of the control valve substantially equal to a pressure of the pressurized fluid biasing the control valve towards the second position.

Preferably, the first position of the control valve opens a fluid flow path from the pressurized fluid supply to a first chamber of the actuator and wherein the second position of the control valve opens a fluid flow path from the pressurized fluid supply to a second chamber of the actuator.

According to an aspect of the invention, an actuation system including a fluid operated actuator, comprises:

a control valve movable between a first position and a second position;

a first fluid conduit coupling the control valve to a first chamber of the fluid operated actuator, wherein the first position of the control valve opens a fluid flow path to pressurize the first fluid conduit and the first chamber with fluid from a pressurized fluid supply; and a second fluid conduit coupled to the first chamber and adapted to divert a portion of the pressurized fluid supplied to the first chamber to bias the control valve towards the second position.

Preferably, the control valve exhausts the pressurized fluid biasing the control valve once the control valve is actuated to the second position.

Preferably, pressurized fluid exhausted from the first chamber of the fluid operated actuator retains the control valve in the second position.

Preferably, the actuation system further comprises a pressure regulator adapted to reduce the pressurized fluid biasing the control valve towards the second position.

Preferably, the actuation system further comprises a biasing member adapted to substantially close the fluid flow path from the pressurized fluid supply to the fluid operated actuator.

According to an aspect of the invention, an actuation system including a fluid operated actuator, comprises:

a control valve movable between a first position and a second position, a first fluid conduit coupling the control valve to the fluid operated actuator, wherein the first position of the control valve opens a fluid flow path to pressurize the first fluid conduit and a first chamber of the fluid operated actuator with fluid from a pressurized fluid supply; and a second fluid conduit coupled to the first fluid conduit and adapted to divert pressurized fluid in the first fluid conduit to bias the control valve towards the second position.

Preferably, the control valve exhausts the pressurized fluid biasing the control valve once the control valve is actuated to the second position.

Preferably, pressurized fluid exhausted from the first chamber of the fluid operated actuator retains the control valve in the second position.

Preferably, the actuation system further comprises a pressure regulator adapted to reduce the pressurized fluid biasing the control valve towards the second position.

Preferably, the actuation system further comprises a biasing member adapted to substantially close the fluid flow path from the pressurized fluid supply to the fluid operated actuator.

DETAILED DESCRIPTION OF THE INVENTION

Figure 1:
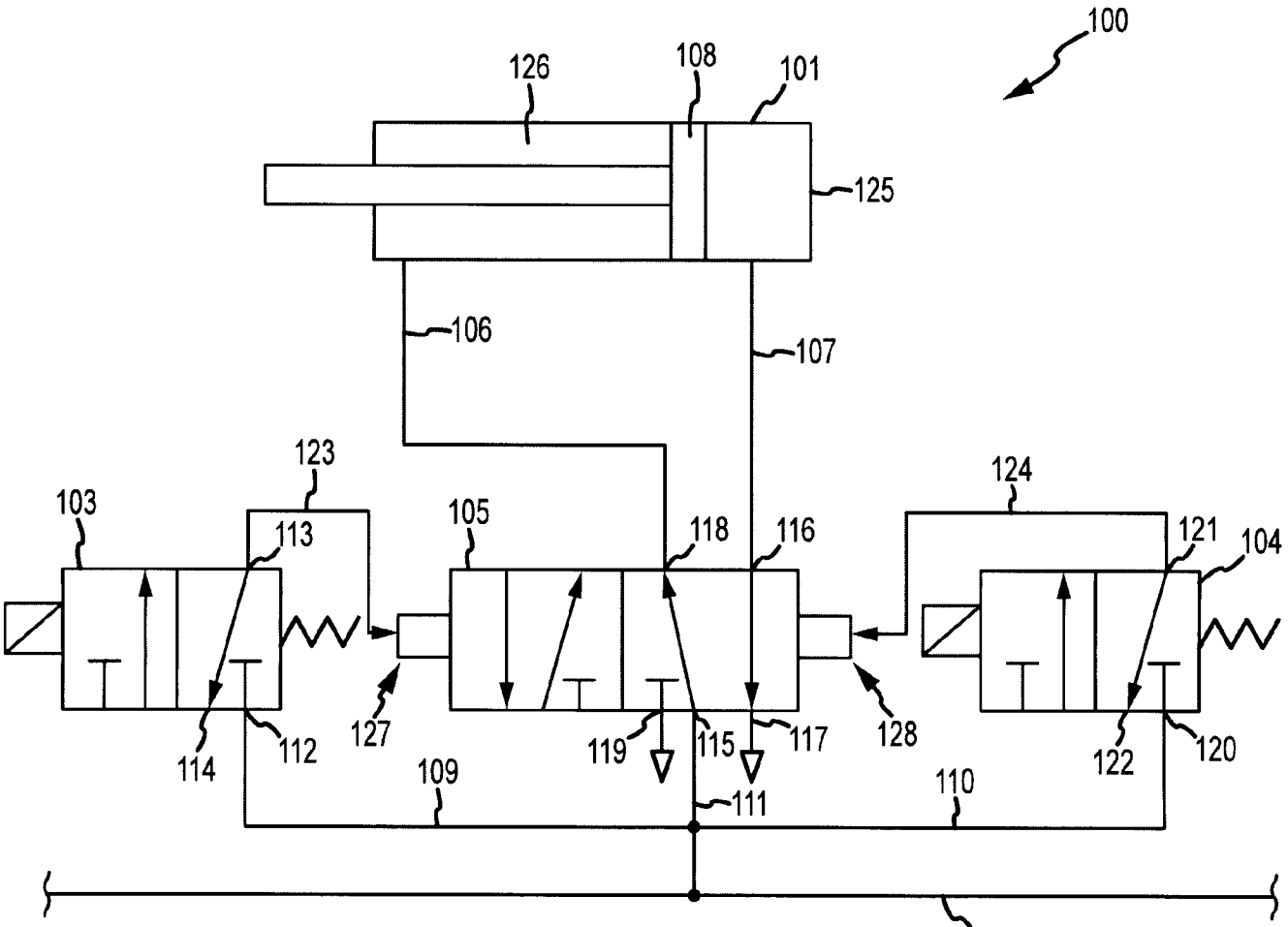
FIG. 1 (PRIOR ART)
FIG. 1 shows a prior art fluid controlled actuator.
Figure 2:
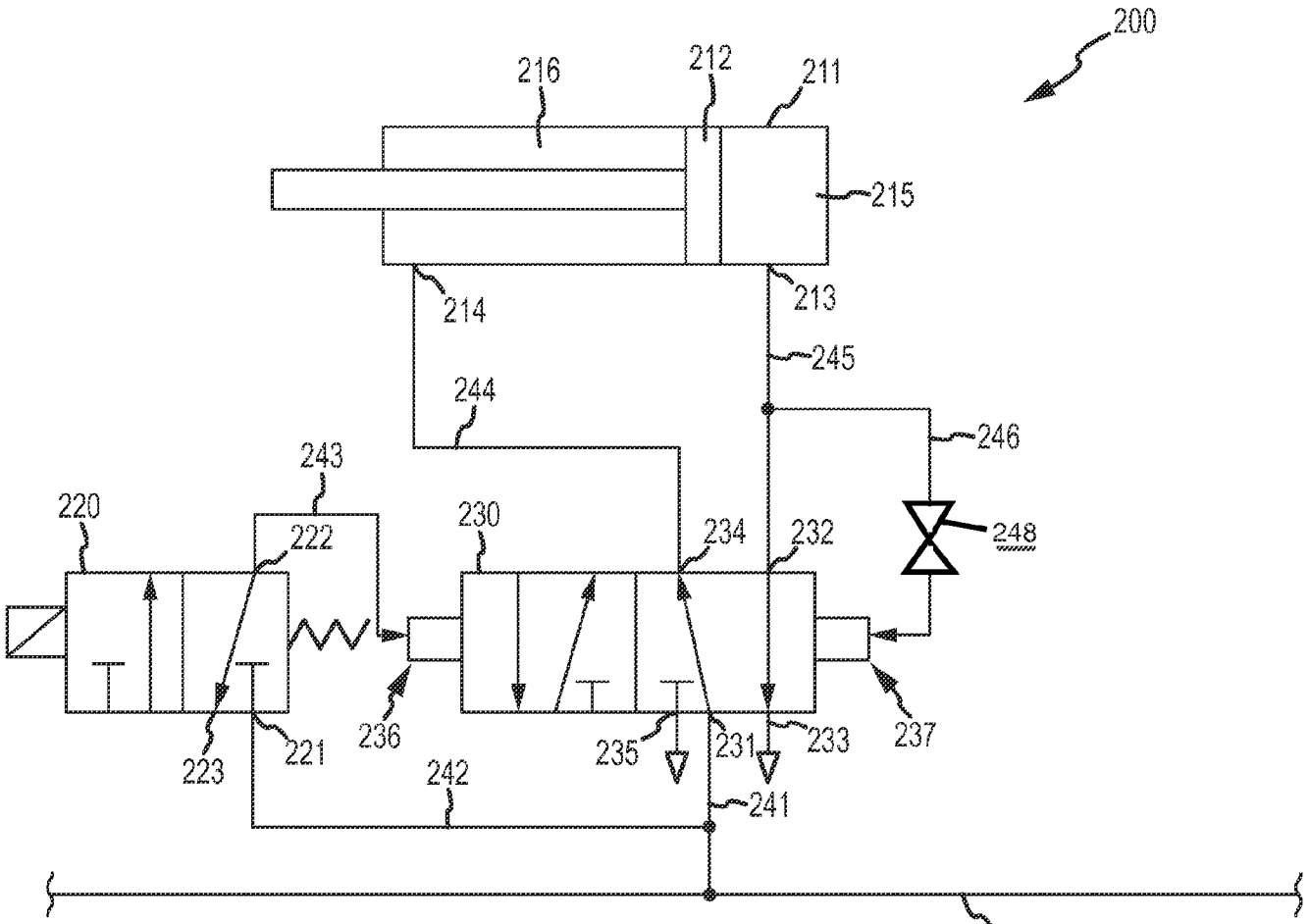
FIG. 2 shows a valve control system according to an embodiment of the invention.
Figure 3:
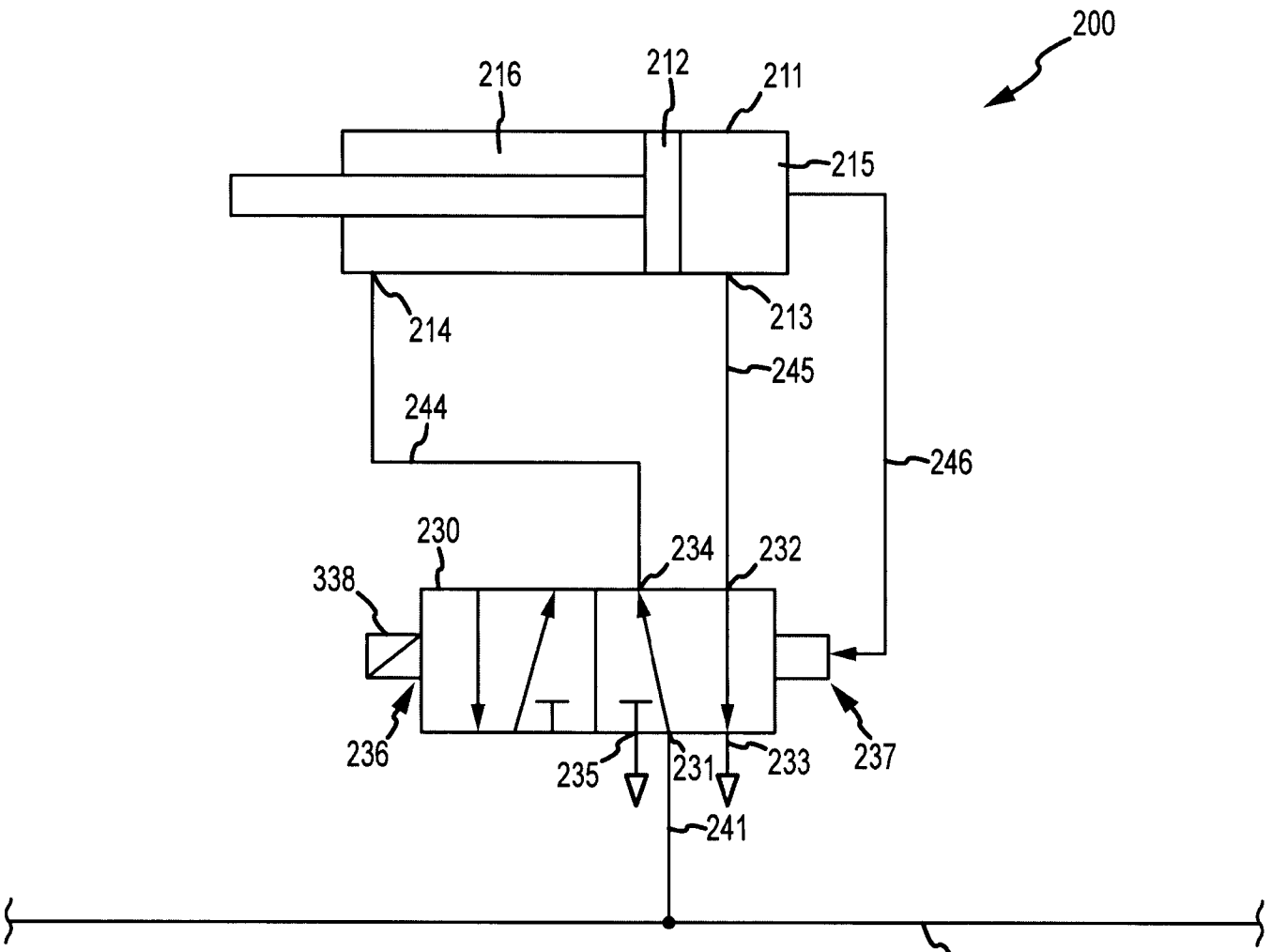
FIG. 3 shows the valve control system according to another embodiment of the invention.
Figure 4:
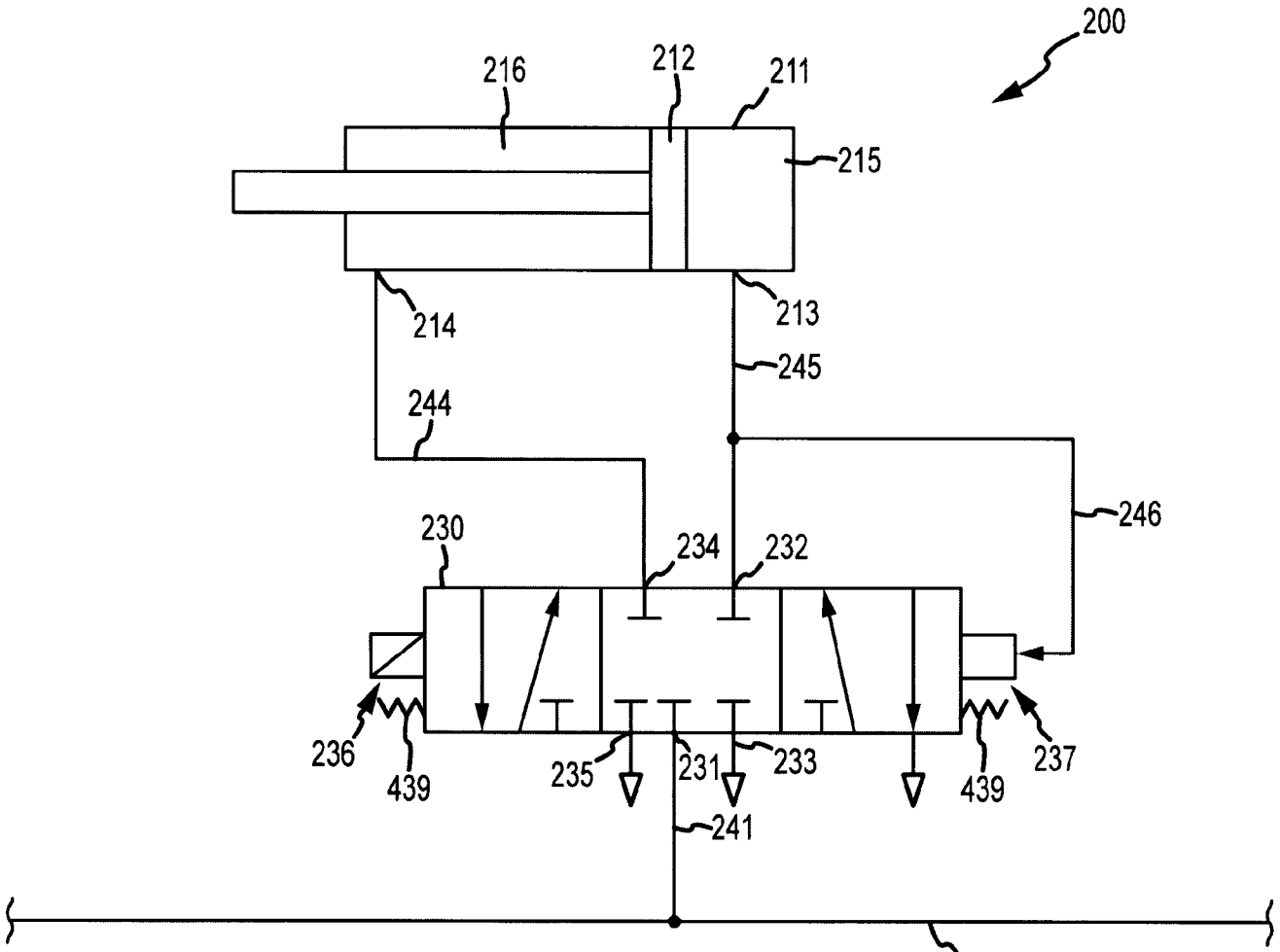
FIG. 4 shows the valve control system according to yet another embodiment of the invention.

FIGS. 2-4 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

FIG. 2 shows an actuation system 200 for a fluid operated actuator 211 according to an embodiment of the invention. The actuation system 200 shown in FIG. 2 comprises the actuator 211, a pilot valve 220, a control valve 230, and a fluid supply 240. The fluid supply 240 may comprise a pneumatic or hydraulic fluid supply, for example. It should be understood however, that other fluids generally used to operate fluid actuated devices may be used as is known in the art.

According to an embodiment of the invention, the actuator 211 comprises a linear actuator. However, it should be understood that other actuators may be used and the particular fluid operated actuator should not limit the scope of the invention. According to an embodiment of the invention, the actuator 211 includes a piston 212 along with fluid ports 213, 214. Although two fluid ports are shown, the actuator 211 may comprise any number of fluid ports as required by the particular application. The piston 212 can move in response to fluid introduced through one of the ports 213, 214 while the other port is exhausted. For example, when fluid is supplied to the first port 213, fluid can enter the chamber 215 to raise the pressure. In response to the raised pressure, the piston 212 can move to the left (as shown in FIG. 2) and fluid in chamber 216 can be exhausted through the second port 214. Similarly, when fluid is supplied to the second port 214 and chamber 216, the piston 212 can move to the right and fluid in chamber 215 is exhausted through the first port 213.

According to an embodiment of the invention, the actuation system 200 includes a pilot valve 220. According to an embodiment of the invention, the pilot valve 220 comprises a solenoid powered pilot valve 220. However, it should be understood that other pilot valves may be used and are within the scope of the invention. The description that follows discusses the pilot valve 220 as a solenoid powered valve solely for the purpose of clarity and should not in any way limit the scope of the invention. When energized, the pilot valve 220 opens port 221 to port 222. This pressurizes conduit 243 with fluid from conduit 242. The pressurized fluid in conduit 243 acts on a first side 236 of the control valve 230 to bias the control valve 230 towards a first position. It should be understood that although the pressurized fluid in conduit 243 biases the control valve towards the first position, the valve will not be actuated unless the biasing force is sufficient to overcome the control valve's resistive forces, such as friction or existing fluid pressure. Once the biasing force is great enough, the control valve 230 will actuate to the first position. The first side 236 of the control valve 230 may comprise a fluid actuating switch, for example.

According to an embodiment of the invention, the control valve 230 comprises a gate valve. However, it should be understood that the control valve 230 is not limited to gate valves and other suitable valves may be used and remain within the scope of the invention. In the embodiment shown in FIG. 2, the control valve 230 comprises a 5/2 valve, as it has five ports with two positions. In the first position, pressurized fluid is allowed to flow to the first chamber 215 of the actuator 211 while pressurized fluid is exhausted from the second chamber 216. In the second position, pressurized fluid is allowed to flow to the second chamber 216 while being exhausted from the first chamber 215. However, it should be understood that the control valve 230 according to other embodiments of the invention comprises other types of valves, for example, a 5/3 valve where three positions are available. A possible third position may close all ports of the control valve 230 thereby maintaining a current state of the actuator 211 (See FIG. 4).

Once the fluid in conduit 243 actuates the control valve 230 to the first position, port 231 opens to port 232. Conduit 241, which is coupled to the fluid supply 240 can then pressurize conduit 245. The conduit 245 is coupled to the first port 213 of the actuator 211. Thus, the pressurized fluid enters the first chamber 215 thereby acting on the right side of the piston 212 and moving it towards the left. In addition to port 231 being opened to port 232, port 234 is opened to port 235. According to one embodiment, the port 235 comprises an exhaust port, which exhausts to the atmosphere. However, in other embodiments where it is desired to recycle the fluid, the port 235 may be coupled to a reservoir (not shown) and stored for future use. Therefore, as the piston 212 moves to the left, fluid in chamber 216 can exhaust from port 214 through conduit 244 and ports 234, 235 of the control valve 230.

According to an embodiment of the invention, a diverting fluid conduit 246 is coupled to the actuator supply conduit 245. The diverting fluid conduit 246 is also coupled to a second side 237 of the control valve 230. Therefore, when the supply conduit 245 is pressurized, the diverting fluid conduit 246 is also pressurized. The pressure within the diverting conduit 246 acts on the second side 237 of the control valve 230 to bias the control valve 230 towards a second position. According to an embodiment of the invention, even though the pressurized fluid in the diverting fluid conduit 246 biases the control valve towards the second position, the control valve 230 does not change positions because the pressure acting on the first and second sides 236, 237 of the control valve 230 is substantially the same and therefore cancel each other out. This is because the fluid acting on both sides is from the same fluid supply 240. In other words, the left and the right side of the control valve 230 are pressurized at substantially the fluid supply pressure acting on the actuator 211. In other embodiments, the pressure in conduit 246 may be more or less than the pressure in conduit 243. This may be accomplished using a pressure regulator (not shown), for example. It should be understood that in order for the control valve 230 to actuate to the second position, the biasing force provided by the pressure in the diverting fluid conduit 246 must be greater than any frictional force or actuating force applied opposite the pressure in the diverting fluid conduit 246.

According to an embodiment of the invention, the actuator 211 can be actuated in the opposite direction by de-actuating the pilot valve 220. According to an embodiment of the invention, de-actuating the pilot valve 220 closes off port 221 from the port 222 and thus, the pressure acting on the first side 236 of the control valve 230 is exhausted through port 223. However, the fluid pressure in conduit 246 still acts on the second side 237 of the control valve 230. Thus, the biasing force provided by the pressure in the diverting conduit 246 actuates the control valve 230 to the second position. According to an embodiment of the invention, when the control valve 230 is in the second position, the port 231 is closed off from the port 232 and is opened to the port 234, thereby supplying pressurized fluid to the conduit 244, which enters chamber 216 to bias the piston 212 to the right. With chamber 216 being pressurized, fluid in chamber 215 is forced out of the actuator 211 through the port 213 to conduit 245. In addition to the pressurized fluid being exhausted through conduit 245, pressure is still applied to the second side 237 of the control valve 230 via conduit 246. According to an embodiment of the invention, the pressure supplied to the second side 237 of the control valve 230 while chamber 215 is being exhausted is less than the pressure being supplied to the actuator 216. According to another embodiment, as the pressure in the first chamber 215 decreases, the pressure in conduit 246 acting on the second side of the control valve 230 also decreases. Because at least some pressure remains on the second side 237 of the control valve 230, the control valve 230 is retained in the second position. According to another embodiment of the invention, the conduit 245 may include a check valve, which would restrict flow to conduit 246 when chamber 215 is being exhausted. In this embodiment, the control valve 230 may not require a force to retain it in a given position. Therefore, in the brief time after pressure is restricted from acting on the first side 236 of the control valve 230, the pressure still acting on the second side 237 of the control valve 230 could move the control valve 230 to its second position and once the valve 230 switches and the chamber 215 is exhausted, fluid pressure would be removed from the second side 237 of the control valve 230 as well.

FIG. 3 shows the actuation system 200 according to another embodiment of the invention. In the embodiment shown in FIG. 3, the pilot valve 220 is omitted. Rather than using a pilot valve to actuate the control valve 230 to the first position, an electronic actuator 338 is provided. The electronic actuator 338 may comprise a solenoid or may comprise some other electronic actuator. In the embodiment shown in FIG. 3, the control valve 230 is actuated to the first position when the electronic actuator 338 is energized. As described above, when in the first position, the control valve 230 supplies the pressurized fluid to the first chamber 215 of the actuator 211. In addition, the diverting fluid conduit 246 is now coupled directly to the first chamber 215 rather than being coupled to the fluid conduit 245. Therefore, pressurized fluid in the first chamber 215 can be diverted to the second side of the control valve 230 using the diverting fluid conduit 246 to bias the control valve towards the second position. As mentioned above, the control valve 230 will not actuate to the second position unless the biasing force can overcome the friction force of the control valve 230 along with whatever actuating force is provided on the first side of the control valve. According to an embodiment of the invention, the electronic actuator 338 can provide substantially the same force as provided by the pressurized fluid supply. Therefore, when the control valve 230 is in the first position, the actuating force provided by the electronic actuator 338 is substantially the same as the biasing force provided by the fluid pressure via conduit 246. Thus, while the electronic actuator 338 is actuated, the biasing force provided by the pressure in the diverting fluid conduit 246 does not result in any movement of the control valve 230.

According to an embodiment of the invention, once the electronic actuator 338 is de-energized, the fluid pressure in conduit 246 acting on the second side 237 of the control valve 230 actuates the control valve 230 to the second position in order to provide the pressurized fluid supply to the second chamber 216 of the actuator 211 and exhaust the first chamber 215 of the actuator 211. It should be understood that although an electronic actuator 338 has been shown in place of the pilot valve 220, other means of actuating the control valve 230 to the first position could be used. For example, a mechanical actuator, such as a spring, plunger, lever, cam roller, etc. may be used to actuate the control valve 230 to the first position. The control valve 230 can then utilize the pressurized fluid being supplied to the actuator 211 to actuate the control valve 230 to the second position.

FIG. 4 shows the actuation system 200 according to another embodiment of the invention. In the embodiment shown in FIG. 4, the control valve 230 comprises a 5/3 way spring centered valve. As can be seen, the control valve 230 is actuated to the first position using a solenoid actuator 338 and actuated to the second position using the pressurized fluid supplied to the first chamber 215 of the actuator 211. In addition, the control valve 230 is centered to a third position using biasing members 439. In the third position, all of the ports of the control valve 230 are closed. Therefore, the current position of the actuator 211 is maintained as no fluid enters or leaves the actuator 211. According to an embodiment of the invention, the control valve 230 shown in FIG. 4 operates in substantially the same manner as the control valve 230 shown in FIG. 3 with respect to the first and second positions. It should be understood that although the control valve 230 is shown with a pair of biasing members 439 used to center the valve 230 to the center position, other actuating members could be used and the present invention should not be limited to the use of biasing members.

The invention described above comprises an actuation system 200 that uses the pressure acting on a fluid operated actuator to actuate the control valve 230 from a first position to a second position. Thus, invention eliminates the need for a second actuator, such as a second pilot valve.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other actuator systems, and not just to the embodiments described above and shown in the accompanying figures. Accordingly, the scope of the invention should be determined from the following claims.

We claim:

1. A method for operating a control valve adapted to selectively provide a pressurized fluid supply to an actuator, comprising the steps of:

actuating the control valve to a first position to open a fluid flow path from a pressurized fluid supply to a first chamber of the actuator, wherein the pressurized fluid supplied to the first chamber of the actuator also biases the control valve towards a second position, and wherein the control valve is actuated to the first position by applying a force to a first side of the control valve substantially equal to a pressure of the pressurized fluid biasing the control valve towards the second position, and wherein pressurized fluid exhausted from the first chamber of the actuator retains the control valve in the second position.

2. The method of claim 1, further comprising the step actuating the control valve to the second position with the pressurized fluid supplied to the actuator.

3. The method of claim 1, wherein the pressurized fluid biasing the control valve towards the second position is exhausted once the control valve is in the second position.

4. The method of claim 1, wherein the first position of the control valve opens a fluid flow path from the pressurized fluid supply to a first chamber of the actuator and wherein the second position of the control valve opens a fluid flow path from the pressurized fluid supply to a second chamber of the actuator.

5. An actuation system (200) including a fluid operated actuator (211), comprising:

a control valve (230) movable between a first position and a second position;

a first fluid conduit (245) coupling the control valve (230) to a first chamber (215) of the fluid operated actuator (211), wherein the first position of the control valve (230) opens a fluid flow path to pressurize the first fluid conduit (245) and the first chamber (215) with fluid from a pressurized fluid supply (240); and a second fluid conduit (246) coupled to the first chamber (215) and adapted to divert a portion of the pressurized fluid supplied to the first chamber (215) to bias the control valve (230) towards the second position, wherein the control valve is actuated to the first position by applying a force to a first side of the control valve substantially equal to a pressure of the pressurized fluid biasing the control valve towards the second position, and wherein pressurized fluid exhausted from the first chamber of the fluid operated actuator retains the control valve in the second position.

6. The actuation system (200) of claim 5, wherein the control valve (230) exhausts the pressurized fluid biasing the control valve (230) once the control valve (230) is actuated to the second position.

7. The actuation system (200) of claim 5, further comprising a pressure regulator adapted to reduce the pressurized fluid biasing the control valve (230) towards the second position.

8. The actuation system (200) of claim 5, further comprising a biasing member (439) adapted to substantially close the fluid flow path from the pressurized fluid supply (240) to the fluid operated actuator (211).

9. An actuation system (200) including a fluid operated actuator (211), comprising:

a control valve (230) movable between a first position and a second position, a first fluid conduit (245) coupling the control valve (230) to the fluid operated actuator (211), wherein the first position of the control valve (230) opens a fluid flow path to pressurize the first fluid conduit (245) and a first chamber (215) of the fluid operated actuator (211) with fluid from a pressurized fluid supply (240); and a second fluid conduit (246) coupled to the first fluid conduit (245) and adapted to divert pressurized fluid in the first fluid conduit (245) to bias the control valve (230) towards the second position, wherein the control valve is actuated to the first position by applying a force to a first side of the control valve substantially equal to a pressure of the pressurized fluid biasing the control valve towards the second position, and wherein pressurized fluid exhausted from the first chamber of the fluid operated actuator retains the control valve in the second position.

10. The actuation system (200) of claim 9, wherein the control valve (230) exhausts the pressurized fluid biasing the control valve (230) once the control valve (230) is actuated to the second position.

11. The actuation system (200) of claim 9, further comprising a pressure regulator adapted to reduce the pressurized fluid biasing the control valve (230) towards the second position.

12. The actuation system (200) of claim 9, further comprising a biasing member (439) adapted to substantially close the fluid flow path from the pressurized fluid supply (240) to the fluid operated actuator (211).

* * * * *